US008596907B2

(12) United States Patent
von Wedel

(10) Patent No.: US 8,596,907 B2
(45) Date of Patent: Dec. 3, 2013

(54) LIFTING SYSTEM

(75) Inventor: Henning von Wedel, Hamburg (DE)

(73) Assignee: Waertsilae Ship Design Germany GmbH, Hamburg (DE)

( * ) Notice: Subject to any disclaimer, the term of this patent is extended or adjusted under 35 U.S.C. 154(b) by 154 days.

(21) Appl. No.: 13/061,923

(22) PCT Filed: Jul. 28, 2009

(86) PCT No.: PCT/EP2009/005469

§ 371 (c)(1),
(2), (4) Date: Apr. 4, 2011

(87) PCT Pub. No.: WO2010/031462

PCT Pub. Date: Mar. 25, 2010

(65) Prior Publication Data

US 2011/0206464 A1 Aug. 25, 2011

(30) Foreign Application Priority Data

Sep. 17, 2008 (DE) ..... 20 2008 012 355 U

(51) Int. Cl.
*B63C 3/06* (2006.01)

(52) U.S. Cl.
USPC ..... 405/3

(58) Field of Classification Search
USPC ..... 405/3, 199, 203, 205
See application file for complete search history.

(56) References Cited

U.S. PATENT DOCUMENTS

| | | | | |
|---|---|---|---|---|
| 2,226,789 | A | 12/1940 | Tupy | |
| 2,308,743 | A | 1/1943 | Bulkley et al. | |
| 2,944,403 | A | 7/1960 | Smith | |
| 2,967,400 | A | 1/1961 | Grant et al. | |
| 3,118,283 | A | 1/1964 | True et al. | |
| 3,717,001 | A | 2/1973 | Tam | |
| 4,069,681 | A | 1/1978 | Mott | |
| 4,655,640 | A * | 4/1987 | Gillis | 405/198 |
| 7,246,972 | B2 * | 7/2007 | Tormala et al. | 405/199 |
| 2008/0025799 | A1 * | 1/2008 | Kawasaki | 405/198 |
| 2008/0131209 | A1 * | 6/2008 | Thomas | 405/198 |

FOREIGN PATENT DOCUMENTS

| | | |
|---|---|---|
| DE | 1199951 | 9/1965 |
| DE | 1484525 | 9/1965 |
| DE | 2651022 | 5/1978 |
| DE | 3608756 | 10/1987 |

OTHER PUBLICATIONS

Translation of the International Preliminary Report on Patentability; International Application No. PCT/EP2009/005469.

V. Lindner; International Search Report; PCT/EP2009/005469; Oct. 7, 2010.

* cited by examiner

*Primary Examiner* — Benjamin Fiorello

(74) *Attorney, Agent, or Firm* — Studebaker & Brackett PC

(57) ABSTRACT

A lifting system for navigable watercraft or marine vessels for temporary stationary positioning of the vessel on a seabed includes supporting legs that may be lowered and raised, and a locking and braking device to provide a force locking engagement with the respective supporting leg. The lifting system also includes a hydro-mechanical device, combined with hydraulic devices, to allow a stationary position of a raised vessel and a lowering of the vessel during transition to a travelling position to be achieved.

8 Claims, 2 Drawing Sheets

15
10
5
13
26
27
20
31
11
36
35
23
15
24
13
16
11

23
15
5
10
26
16
32
11
35
20

23
15
10
16
5
26
32
11
35
36
42
20
1
45

LIFTING SYSTEM

TECHNICAL FIELD

The invention relates to a lifting system for a watercraft, in particular a feeder lifting vessel, according to the introductory clause of claim 1.

BACKGROUND

Lifting systems of a comparable nature are known for example from DE 100 21 163 A1, DE 2 041 925 A1, EP 1 795 443 A1, EP 094 434 A1 or U.S. Pat. No. 6,808,337 B1, U.S. Pat. No. 4,456,404.

DE 2 041 925 A1 indicates for example a floating, self-lifting platform but which is equipped with relatively high-resource rack and pinion gears, meaning that lowering and raising of supporting legs takes place relatively slowly by means of this shape locking device.

These lifting systems used with different types of watercraft, stationary offshore structures or working units frequently have the disadvantage that they require relatively high resources in their construction and usually use shape locking lifting and holding systems.

This construction technique does not usually allow relatively rapid positioning of a corresponding watercraft or the overcoming of the stationary state to be achieved.

With the establishment of offshore windparks or other comparable offshore installations such as surveying platforms, artificial islands or also drilling platforms it is increasingly important to guarantee in the supply of these offshore installations a rapid and reliable transport also of required components which are as large as possible to these fixed location offshore installations which can be quickly assembled.

It is thus endeavoured to separate the logistics chain for the supply of such offshore installations into the fields of transport and installation of the supply goods and components.

For the efficient transport of components and parts from the port for example to an offshore windpark it would thus be advantageous to be able to couple the advantages of a feeder lifting island with those of a transport vessel. It would mean on the one hand that the sea swell during the time of unloading of the supply goods is irrelevant and on the other hand that due to the function of the transport vessel high flexibility, speed and economy are achieved.

SUMMARY

It is thus the object of the invention to create a lifting system for watercraft, in particular for transport vessels in the form of feeder lifting vessels, which can be supported by means of supporting legs temporarily on the sea or ocean floor, whereby the lifting system is to be cost-effectively designed and from a time viewpoint is to facilitate relatively rapid positioning at the corresponding sea position and also a relatively rapid lifting of supporting legs used.

This object is realised according to the invention through the features of claim 1. An essential core idea can thereby be seen on the one hand in creating a force locking arrangement between the hull or body of the watercraft and the supporting legs which can be lowered and raised.

An extensively continuous lowering of supporting legs onto the seabed can hereby take place so to speak. The reverse process of the lifting or floating of the supporting legs can also be carried out extensively continuously and smoothly in this way so that there are no temporal intermediate points that would slow down these processes.

In addition a constructive combination between a hydraulic sub-area of the lifting system and a hydro-mechanical sub-area is to be realised particularly advantageously.

This latter hydro-mechanical sub-area of the lifting system is to be understood in a simplified way as the flooding of a corresponding supporting leg, in particular in association with a floating body or a flooding and buoyancy body, in such a way that in association with the force locking and usefully hydraulically actuated locking and braking system a rapid lowering but also a relatively rapid floating or upward movement of the supporting legs is possible with the use of compressed air.

A transport vessel equipped with such a lifting system also allows the temporary stationary positioning by means of supporting legs on the seabed to also be overcome once again relatively rapidly.

In this connection a pushing out or blowing out of the water out of the respectively flooded supporting leg with buoyancy or floating body is necessary, whereby the floating of the supporting leg into an upper, locked rest or transport position can be carried out relatively rapidly and extensively continuously.

The lifting system also allows a watercraft equipped therewith to be extensively independent and uninfluenced by the sea swell, especially in the phase of transfer or assumption of components to and from the stationary offshore installations.

After the supporting of the watercraft via the corresponding supporting legs on the seabed the locking device allows the watercraft to be fixed on the supporting legs at the corresponding height so that subsequently, by means of the lifting device which is usefully equipped with lifting cylinders, the watercraft can be raised further relative to the supporting legs so that floating in waves is prevented.

In this position a part of the underwater vessel, for example the keel area or vessel bottom, is still in water contact with the surrounding sea.

For the temporary stationary positioning of the vessel or watercraft on the seabed the lifting system provides supporting legs which can be lowered and raised which cooperate with a lowering device and a lifting device. An essential idea of the invention can hereby be seen in the arrangement of a locking and braking device which is designed for a force locking engagement with the respective supporting leg. This is facilitated on the one hand by means of wing elements or brake rails extending in the longitudinal direction of the supporting leg. Furthermore a lifting device is functionally connected with this locking and braking device, which lifting device is on the other hand fixed to the hull of the vessel. When the supporting legs are lowered this lifting device, which is usefully based upon the hydraulic principle, allows further raising of the hull of the vessel so that floating in a wave is prevented.

The locking and braking device is advantageously equipped with brake callipers or brake shoes which can be brought into engagement in a force locking way with the wing elements which are simply flat iron elements and are arranged offset by 180° on opposing sides of the hollow cylindrical supporting leg.

The force locking engagement can possibly be further improved through shape locking contours in the region of the wing elements or brake rails.

A further essential feature of the invention can be seen in the connection of the hollow cylindrical and watertight supporting legs with a floating body provided in the lower region of the supporting leg which can also be described as a flooding and buoyancy body. It is hereby possible to facilitate a relatively rapid and extensively continuous lowering of the supporting legs at the determined position through simple flooding of the supporting leg and the flooding and buoyancy body with simultaneously controlled braking device.

Inversely, through the blowing-in of compressed air into the hollow cylindrical supporting legs and the buoyancy body the water is blown out so that a relatively rapid but controlled floating of the corresponding supporting leg is thereby realised.

The combination of force locking engagement on the supporting leg via the locking and braking device in cooperation with the usefully hydraulically designed lifting device and the hydro-mechanically designed lowering and floating device of the supporting leg and floating body thus allows a constructively relatively simple but very efficiently constructed lifting system, with high stability in transfer positions of components to a stationary offshore installation, with which possibility of use of a vessel with such a lifting system is achieved which is extensively independent of the sea swell.

Essential core elements of the lifting system can thus be seen on the one hand as the hollow watertight supporting legs with floating body which can be flooded and drained through compressed air. In addition there is on the other hand the locking and braking device, with which the relative movement of the floating supporting legs relative to the hull of the vessel can be braked in a defined way until the vessel is fixed with its supporting legs on the seabed.

The weight of the supporting legs is to be dimensioned so that through the flooding of the floating body which functions as a flooding and buoyancy body in association with the fill level of the supporting leg the latter floats or sinks. The upper region of the floating body should thereby float in the water-free state planar on the water surface.

At the lower end of the supporting legs there is appropriately a conical tip which allows better engagement into the seabed. At the transition between the cone and the smooth pipe of the supporting leg air outlet holes are usefully provided which prevent in the manner of an overpressure valve an inner pressure which is too great from building up in the floating body. Upon emptying of the floating body by means of compressed air these outlet holes additionally ensure that the lower end of the supporting leg with conical tip can be released relatively easily from the seabed.

After the lowering of the supporting legs on the seabed the locking device comprising an annular body is fixed by means of the force locking engagement between brake callipers or brake shoes on the wing elements or brake rails of the supporting legs. The hull of the vessel thus hangs via the lifting device on the corresponding annular bodies. The lifting device equipped in an appropriate way with hydraulic cylinders can then lift the vessel from this position further out of the water until the desired working position for transfer or assumption of components can be achieved independently of the sea swell.

The path which the hydraulic cylinders must thereby cover depends upon the penetration depth of the supporting leg into the seabed and upon the wave height. The vessel must be lifted so high that even in the unloaded state it does not float in a wave but also not so high that the lower side of the vessel can be damaged by waves.

The number of wing elements or brake rails provided on a supporting leg can be different and can be selected according to carrying capacity. Having regard to a simple arrangement and cost saving two wing elements and two braking systems which are designed for example as double calliper brakes should suffice for each supporting leg.

The functional sequence in the offshore supply of a vessel equipped with such a lifting system is as follows:

After reaching the position of use of the vessel the supporting legs are flooded and lowered on the seabed. Upon floating of the vessel in a wave the locking and braking device is tightened so that the vessel is fixed at this height in relation to the supporting legs. Subsequently the vessel is raised further via the lifting device with for example hydraulic function until its working height is reached. In order to relieve the load of the corresponding lifting devices and the corresponding hydraulic system the forces of the hydraulic system can be assumed in this working position for example by lashing chains, rigid hawsers or similar.

Upon departure of the vessel from the offshore installation firstly the lashing chains are released and the forces are assumed by the lifting device. The vessel is then slowly lowered by means of the lifting device into the water. The supporting legs are then released from the bottom for example hydraulically or also through blowing-through. After the incorporation of compressed air into the supporting legs and the floating body the braking device is released so that the supporting legs can float extensively continuously and completely. In this position the braking devices are tightened and fixed and the floating body is guided into locking saddle elements, in which they can for example be hydraulically locked with bolts. This measure secures the supporting legs with floating body in a position of rest and especially upon travel of the vessel.

An improvement in the braking device can be achieved in that the brake shoes for example have a wedge shape so that in case of an increase in the carrying load a greater holding force is also produced.

The corresponding lifting system thus facilitates the combination of hydraulic and hydro-mechanical lifting mechanism without the transition from one method to the other being prevented by sea swell influences. At the same time the lifting system is rapid and cost-effective as it uses the buoyancy forces of the hollow cylindrical supporting legs with floating body so that a relatively rapid movement of the supporting legs into their locked position is possible even with greater water depths.

BRIEF DESCRIPTION OF DRAWINGS

The invention is explained in greater detail below by reference to an example and schematic drawings, in which.

DETAILED DESCRIPTION

Figure 1:
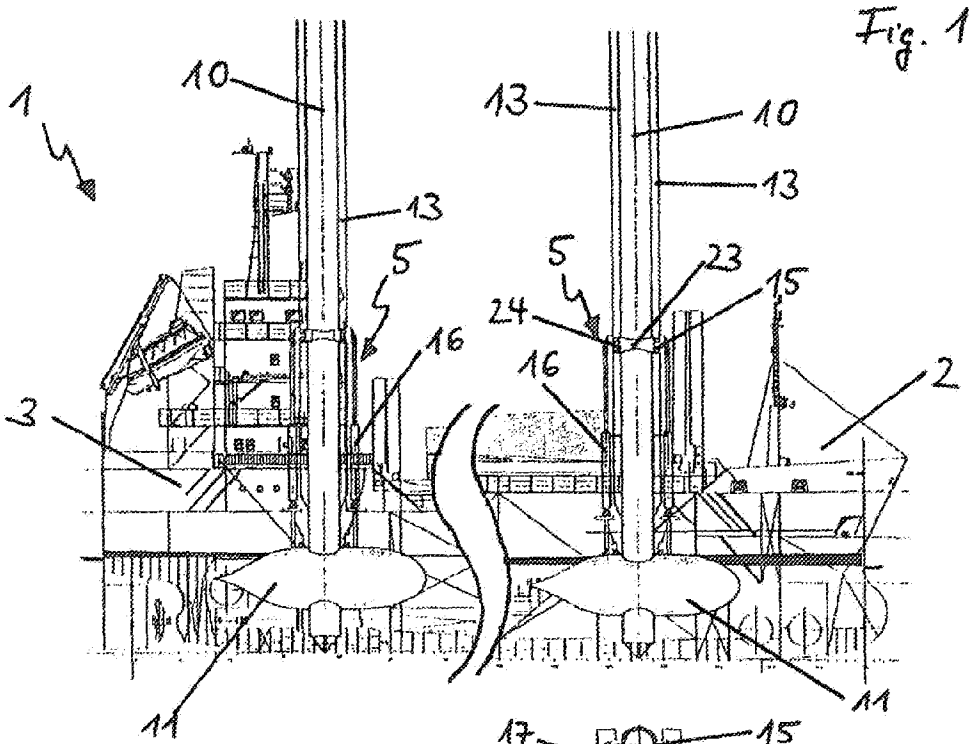
FIG. 1 shows a schematic side view of a vessel equipped with such a lifting system, wherein the middle vessel hull in longitudinal direction has been left out for reasons of simplification.

FIG. 1 shows a vessel 1 in a side view with lifting systems 5. A representation which is shortened in the length of the vessel without the middle longitudinal area of the vessel 1 is shown as in the example the lifting systems 5 are arranged in the front and rear area of the vessel 1.

Figure 4:
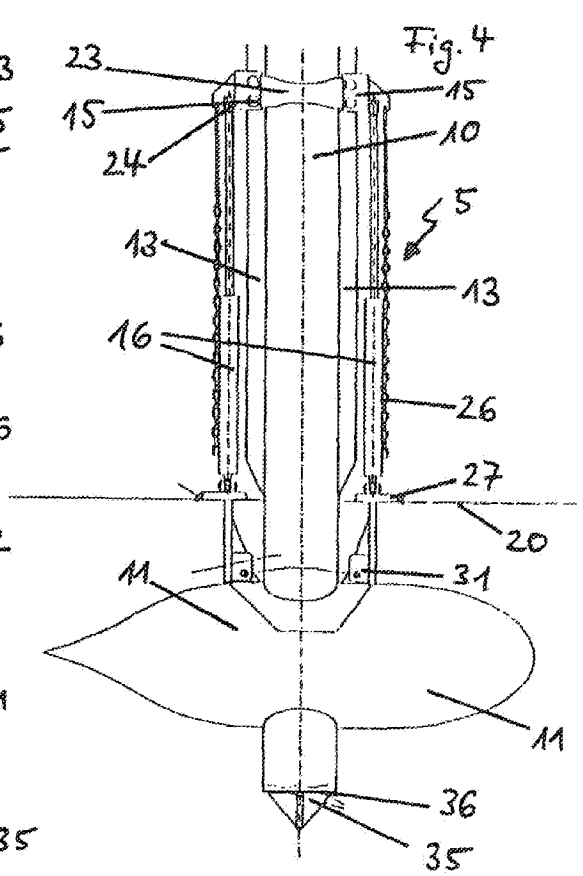
FIG. 4 a side view of the lifting system according to FIG. 3 with a view towards the side of the vessel and FIG. 5 the lifting system according to FIG. 3 in a lowered position of the corresponding supporting leg onto the seabed.

The lifting system 5 comprises a supporting leg 10 with wing elements 13 or brake rails provided on the outer side. This supporting leg 10 has a floating body 11 integrated in the lower region, on which the lower part of the supporting leg 10 continues downwardly with a conical tip 35 (see also FIG. 4).

The lifting system 5 is further characterised by an annular body 23 around the supporting leg 10 which receives brake callipers 24 or brake shoes in the opposite-lying area. On both sides of this annular body 23, in the example parallel to the mid-vessel axis, a lifting device with two lifting cylinders 16 is furthermore provided. These lifting cylinders 16 are attached in the example (FIG. 4) fixedly to the vessel body 20.

In the position of rest or travel of the vessel 1 the supporting legs 10 are raised so far that the upper area of the floating body 11 fixed in a locking saddle element 31 (FIG. 4) comes to lie approximately at the height of the water line. At the same time it can be seen that the conical tip 35 does not come to lie below the ship bottom.

Corresponding to FIG. 1 two lifting systems 5 are provided in the example on the starboard side, whereby one is arranged in the front ship area 2 and another in the rear ship area 3.

Figure 2:
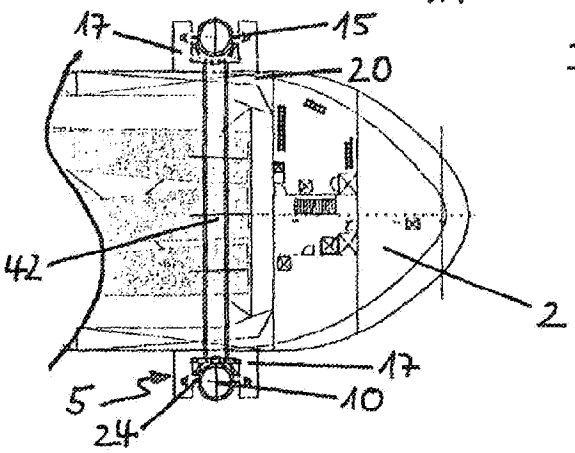
FIG. 2 a top view of the front of the vessel corresponding to FIG. 1.
Figure 5:
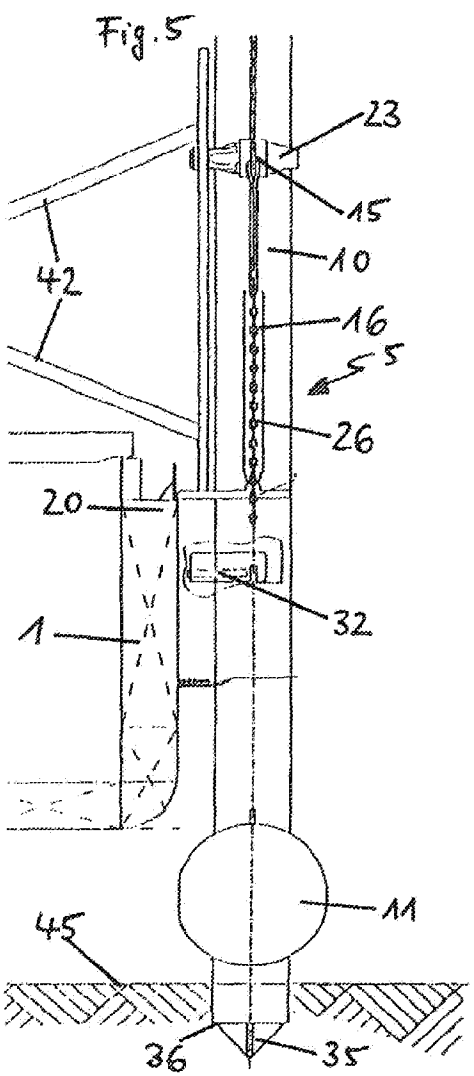

FIG. 2 shows a top view of the front ship area 2 with lifting systems 5 arranged on the starboard and port side. These lifting systems 5 are interconnected for further stabilisation via cross braces 42 (FIG. 5).

Furthermore it can be seen in the top view according to FIG. 2 that U-shaped transverse arms 17 are fixed, in particular being welded, to the vessel body 20. These U-shaped, outwardly open transverse arms 17 receive the lifting systems 5 so to speak. The lower ends of the lifting cylinders 16 hereby rest against these transverse arms 17, are thus fixed thereto in a jointed or rigid way.

Figure 3:
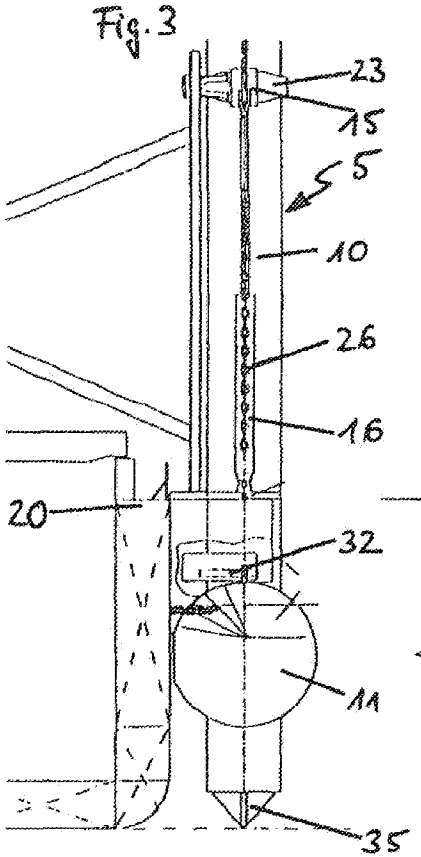
FIG. 3 a schematic view, in longitudinal direction of the vessel, of a lifting system.

FIG. 3 shows in a fragmented view a cut-out of a lifting system 5 in longitudinal direction of the vessel 1. With simultaneous reference to the illustration according to FIG. 4 which shows a lateral top view of a lifting system 5 in a fragmented representation, wing elements or brake rails 13 can be seen on both sides of the hollow cylindrically formed supporting leg 10. An annular body 23 shown in the top region of FIGS. 3 and 4 hereby receives the locking and braking device 15 which comprises brake callipers or brake shoes 24 inside. On the one hand the piston rod of a lifting cylinder 16 engages on the outer flanges of the locking device 15 and on the other hand a lashing chain 26 is arranged in the example. The lifting cylinder 16 and lashing chain 26 are provided on both sides of the annular body 23.

A respective hook for fixing the lashing chain 26 is provided, connected fixedly with the vessel body 20, in the lower area on both sides of the supporting leg 10. In the position of rest or position of travel the drop-form floating body 11 is placed in locking saddle elements 31 for example fixed by means of bolts on the vessel body 20.

In FIG. 3, as seen in the direction of the vessel, this position locked by means of bolts 31 is shown so that also during travel of the vessel 1 or during sea swell a secure fixing of the respective lifting system is achieved.

The floating body 11 has a larger diameter than the cylindrical supporting leg 10. This floating body 11 is somewhat flattened towards the outboard side of the vessel 1 so that a smaller distance is achieved between the vertical longitudinal axis of the lifting system 5 and the vessel body 1.

In FIG. 5, comparably with FIG. 3, a position arrangement is shown, in which the supporting leg 10 of a lifting system 5 is lowered onto or into the seabed 45. In this position the corresponding bolts 32 are unlocked. According to the depth of the vessel 1 the latter can be raised out of this position via the hydraulic cylinders 16 of the lifting device further out of the water so that floating of the vessel 1 can be avoided even when the sea is choppy. In such a position the lashing chains 26 can then be fixed in relation to the hooks 27 and hence the vessel body 20 so that the lifting device can be unloaded in terms of force.

At the end of a supply process between the vessel 1 and an offshore installation (not shown) firstly the lifting device with its lifting cylinders is brought into operation so that the lashing chains 26 can be released. Subsequently, with the fixed position of the locking and braking device 15 in relation to the supporting legs 10, the lifting cylinders 16 are unloaded in terms of force so that the vessel 1 sinks and is guided slowly downwards. This takes place as far as the immersion depth of the vessel body 20 on account of the weight thereby present.

The vessel 1 thus already floats but is supported by means of its for example four lifting systems 5 in and on the seabed 45.

For the lifting process the watertight supporting legs 10 and the floating bodies 11 are impacted with compressed air so that the water present therein is pushed out. This can usefully also take place in part by means of the outlet openings 36 in the region of the conical tip 35 so that the vertical release of the supporting legs 10 from the seabed 45 is facilitated.

In this position and phase the brake shoes 15 are released in the annular body 23 or are connected with an only low and controlled force-based engagement with the wing elements 13 so that an extensively continuous floating of the floating body 11 together with supporting leg 10 is achieved.

When the position of the floating body 11 shown in FIG. 1 is reached the locking and braking device 15 is fixed in relation to the respective supporting leg 10 and the whole lifting system is fixed in the locking saddle elements 31.

The invention claimed is:

1. A lifting system retrofitable on a navigatable watercraft having a starboard side and a port side, the lifting system comprising:

a plurality of supporting legs attached externally to the starboard side and the port side of the watercraft, each of the plurality of supporting legs is adapted to be lowered and raised to temporarily position the watercraft on a seabed in a stationary manner, a leg-lowering-and-raising device and a lifting-support device are provided for each of the plurality of supporting legs, a locking and braking device disposed on each of the plurality of supporting legs, the locking and braking device is adapted to provide a force locking engagement with the respective supporting leg, at least one brake rail disposed on each of the plurality of supporting legs to engage with the locking and braking device;

wherein the lifting-support device is in operative connection with the locking and braking device and the lifting-support device is fixedly attached to the body of the watercraft in such a way that, when the plurality of supporting legs are lowered onto the seabed, the plurality of supporting legs lift the watercraft, wherein the locking and braking device is equipped with at least one brake caliper and with brake shoes adapted to be brought into engagement in a force locking way with the brake rail, each of the plurality of supporting legs is a part of the leg-lowering-and-raising device, and the leg-lowering-and-raising device includes a hydro-mechanical device adapted to fill and empty the respective supporting leg so as to control a buoyancy of the respective supporting leg.

2. The lifting system according to claim 1, wherein the lifting-support device includes a lifting cylinder connected via an annular holder around each of the plurality of supporting legs in at least one of a force locking and shape locking way with the brake caliper and the brake shoes.

3. The lifting system according to claim 2, wherein lashing chains are provided to relieve the load of the lifting cylinders in a raised position of the watercraft.

4. The lifting system according to claim 1, wherein the lifting-support device includes a plurality of U-shaped arms attached to the body of the watercraft, each U-shaped arm is operatively connected to a respective supporting leg.

5. The lifting system according to claim 1, wherein the plurality of supporting legs includes two pairs of supporting legs, a first pair of supporting legs is provide approximately at a front end of the water craft, and a second pair of supporting legs is provided approximately at a rear end of the water craft, such that the port side and the starboard side of the watercraft each has respective supporting leg at the front end and at rear end, and wherein the supporting legs in each of the pairs of support legs is stabilized against each other with a cross brace.

6. The lifting system according to claim 1, wherein each of the plurality of the supporting legs is hollow and cylindrical and includes, at least one flooding and buoyancy body disposed on a lower end of the supporting leg, the flooding and buoyancy body is of an aerodynamic shape and orientated in a longitudinal direction of travel of the watercraft, and the plurality of supporting legs and flooding and buoyancy bodies are watertight.

7. The lifting system according to claim 6, wherein blow-out holes are provided at the lower end of the plurality of supporting legs below the flooding and buoyancy body of each of the plurality of supporting legs.

8. The lifting system according to claim 1, wherein a termination with conical tip is provided at a lower end of each of the plurality of supporting legs.

* * * * *